US006792932B2

(12) United States Patent
Musacchia, Jr.

(10) Patent No.: US 6,792,932 B2
(45) Date of Patent: Sep. 21, 2004

(54) DROP-AWAY ARROW REST

(75) Inventor: John J. Musacchia, Jr., Cartersville, GA (US)

(73) Assignee: Muzzy Products Corporation, Cartersville, GA (US)

( * ) Notice: Subject to any disclaimer, the term of this patent is extended or adjusted under 35 U.S.C. 154(b) by 0 days.

(21) Appl. No.: 10/314,036

(22) Filed: Dec. 4, 2002

(65) Prior Publication Data

US 2003/0127083 A1 Jul. 10, 2003

Related U.S. Application Data

(60) Provisional application No. 60/337,005, filed on Dec. 4, 2001, now abandoned.

(51) Int. Cl.[7] ..... F41B 5/22
(52) U.S. Cl. ..... 124/44.5; 124/89; 124/90
(58) Field of Search ..... 124/41.1, 44.5, 124/80, 88, 89, 90

(56) References Cited

U.S. PATENT DOCUMENTS

| | | | | | |
|---|---|---|---|---|---|
| 2,975,780 | A | | 3/1961 | Fisher | |
| 3,504,659 | A | | 4/1970 | Babington | |
| 4,071,014 | A | | 1/1978 | Trotter | |
| 4,287,868 | A | | 9/1981 | Schiff | |
| 4,452,222 | A | | 6/1984 | Quartino et al. | |
| 4,492,214 | A | | 1/1985 | Kielhoffer | |
| 4,542,732 | A | | 9/1985 | Troncoso | |
| 4,865,007 | A | | 9/1989 | Saunders | |
| 4,865,008 | A | | 9/1989 | Troncoso | |
| 4,879,988 | A | | 11/1989 | Larson | |
| 4,886,038 | A | | 12/1989 | Betters | |
| 4,903,678 | A | | 2/1990 | Walker | |
| 4,917,070 | A | | 4/1990 | Townsend | |
| 5,005,554 | A | | 4/1991 | Shepley et al. | |
| 5,022,378 | A | | 6/1991 | Rhodehouse et al. | |
| 5,140,972 | A | | 8/1992 | Fisk | |
| 5,146,908 | A | | 9/1992 | Larson | |
| 5,161,514 | A | * | 11/1992 | Cary | 124/24.1 |
| 5,205,268 | A | | 4/1993 | Savage | |
| 5,415,154 | A | | 5/1995 | Angeloni | |
| 5,490,492 | A | * | 2/1996 | Savage | 124/44.5 |
| 5,503,136 | A | * | 4/1996 | Tone | 124/44.5 |
| 5,606,961 | A | * | 3/1997 | Basik et al. | 124/44.5 |
| 5,606,962 | A | * | 3/1997 | Troncoso | 124/44.5 |
| 6,082,348 | A | * | 7/2000 | Savage | 124/44.5 |
| 6,178,958 | B1 | | 1/2001 | Gallops, Jr. | |
| 6,615,813 | B1 | * | 9/2003 | Troncoso et al. | 124/44.5 |

* cited by examiner

*Primary Examiner*—Kien Nguyen
(74) *Attorney, Agent, or Firm*—Gerald E. Helget; Briggs & Morgan, P.A.

(57) ABSTRACT

An arrow rest assembly for a compound bow having a riser, a number of cables, and a cable guard mounted to the riser with a slider thereon connected to the cables. The arrow rest assembly consists of an arrow rest movable between a first position wherein an arrow rests upon the arrow rest and a second position wherein the arrow does not rest upon the arrow rest; a drop-away mechanism engaging the arrow rest, the arrow rest moving with the drop-away mechanism between the first and second position in an arc about a center of rotation; and a driving mechanism coupled to the slider and driving the drop-away mechanism.

10 Claims, 5 Drawing Sheets

DROP-AWAY ARROW REST

This application is a continuation of U.S. Provisional Patent Application Ser. No. 60/337,005, filed Dec. 4, 2001, now abandoned.

BACKGROUND OF THE INVENTION

The present invention relates to a drop-away arrow rest for a compound bow, in which the arrow rest is moved by the motion of the slider on the cable guard.

Compound bows normally have two or more lengths of cable trained over limb cable wheels and spanning the length of the bow close to and about parallel to the bowstring. As the arrow is shot, its fletching may strike the cables, causing the fletching to become worn and reducing arrow accuracy.

A solution to this problem is a cable guard, as disclosed in U.S. Pat. Nos. 4,452,222; 4,4542,732; and 6,178,958. Such cable guards generally consist of a rod attached at one end to the bow riser and extending therefrom beyond the cables when the bow is fully drawn and spaced laterally from the bow string sufficiently to avoid any interference therewith; and a cable retaining member or slide mounted on the rod that captures the bow cables.

Another problem with archery bows having a fixed arrow rest is that, as the arrow is shot forward, the fletching contacts the arrow rest, causing wear on the fletching and reduced accuracy.

There is a need for a drop-away rest for a compound bow that is actuated by the movement of the cables along the cable guard as the arrow is shot.

SUMMARY OF THE INVENTION

An arrow rest assembly for a compound bow, the bow having a riser, a plurality of cables, and a cable guard mounted to the riser with a slider thereon connected to the cables, the arrow rest assembly comprising:

(a) an arrow rest movable between a first position wherein an arrow rests upon the arrow rest and a second position wherein the arrow does not rest upon the arrow rest;

(b) a drop-away mechanism engaging the arrow rest, the arrow rest moving with the drop-away mechanism between the first and second position in an arc about a center of rotation; and (c) a driving mechanism coupled to the slider and driving the drop-away mechanism.

DETAILED DESCRIPTION OF THE PREFERRED EMBODIMENT

Figure 1:
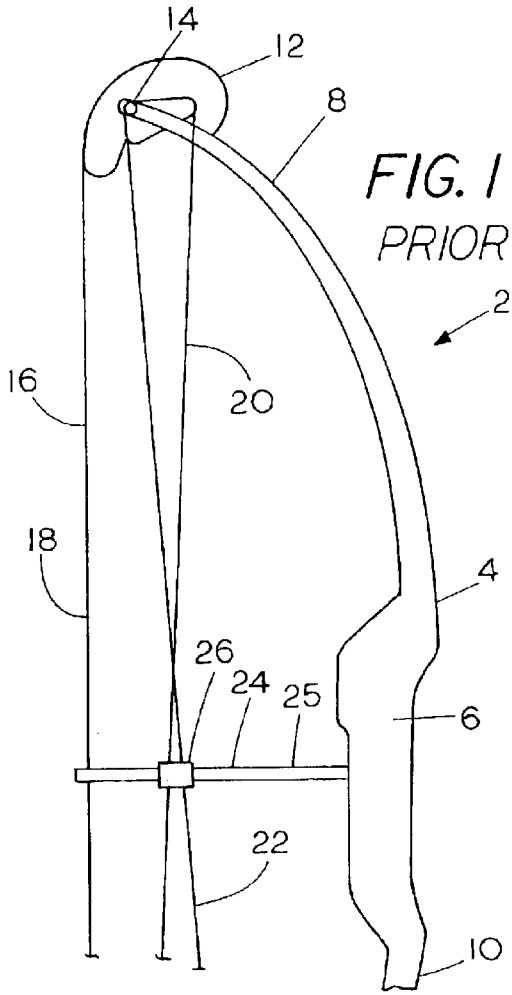
FIG. 1 PRIOR ART
FIG. 1 is a slide elevational view of a compound bow of the prior art.

A compound bow of the prior art is shown in FIG. 1. The bow 2 includes a riser 4 having a handle portion 6. Riser 4 is connected at one end to an upper limb 8 and at the other end to a lower limb 10. A dual-feed cam 12 is mounted to an axial pin 14 which extends through the upper limb 8. A similar cam (not shown) may be mounted to the lower limb 10.

A cable 16 has a medial portion trained around the cam 12 to form a main cable section or bowstring 18 and a secondary return cable 20. The ends of cable 16 pass around eccentric peripheral groove portions of the cam 12 and are connected to it, so that when the bow is shot bowstring 18 and cable 20 will be fed out from cam 12. An anchor cable 22 is anchored at one end of the axle 14 which extends through the top of upper limb 8. The other end of anchor cable 22 passes around the other cam and is connected to it. In this manner, anchor cable 22 forms a direct connection between the limbs 8 and 10.

Cable guard 24 consists of a rod portion 25 mounted to the riser 4 below the handle portion 6. Slidably mounted on the rod portion 25 is a cable retaining means or slider 26. The slider 26 has bores (not shown) which retain cables 20 and 22.

Because of this arrangement, the slider 26 slides along the rod portion 25 as the bowstring is drawn back, in the direction of movement of the bow string 18. When the bowstring is released, the slider 26 slides along the rod portion 25 in the direction of arrow flight.

Figure 2:
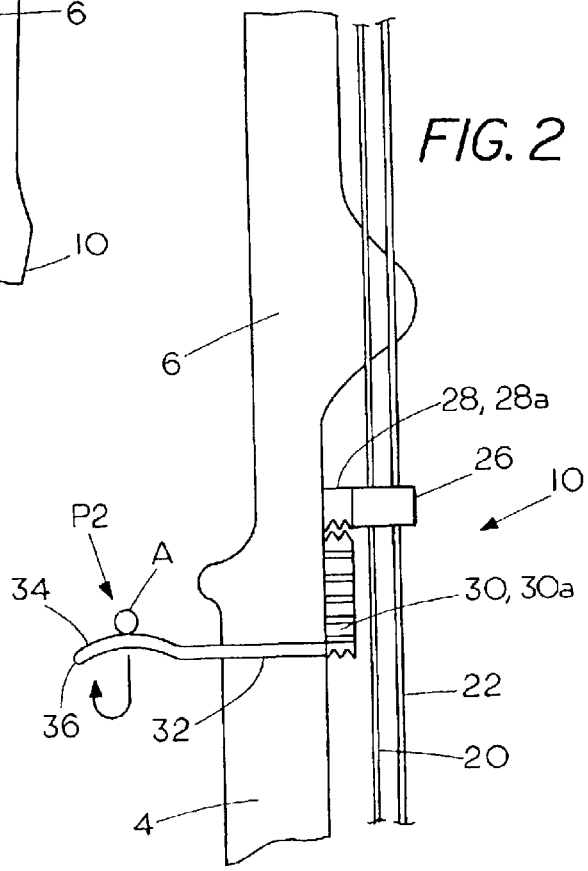
FIG. 2 is a rear elevational view of portion of a compound bow showing the drop-away arrow rest of the present invention in the resting position, before the bowstring is drawn.

FIG. 2 shows a first embodiment of the drop-away arrow rest assembly of the present invention.

Figure 4:
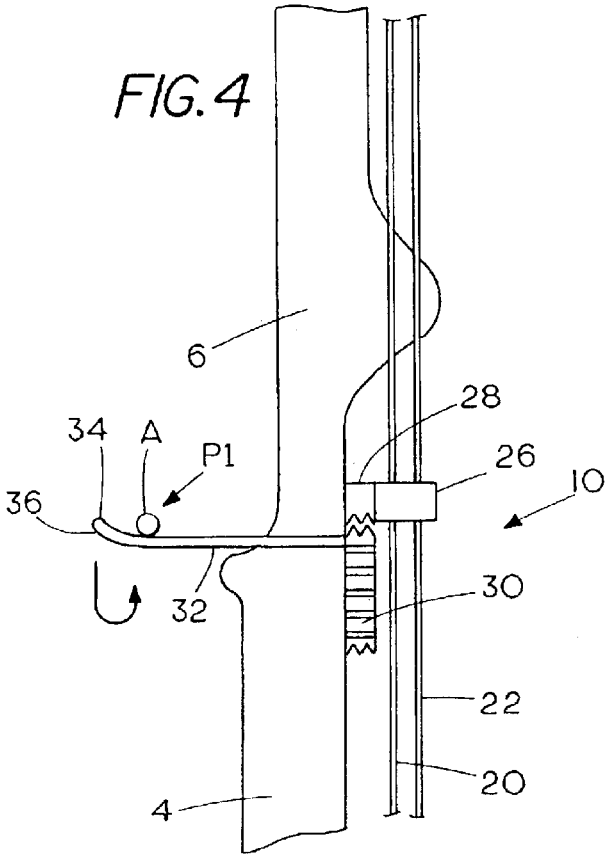
FIG. 4 is the same as FIG. 2, but showing the drop-away arrow rest in the firing position, after the bow string has been drawn.

The arrow rest assembly 10 comprises an arrow rest 34 movable between a first position P1 (FIG. 4) wherein an arrow A rests upon the arrow rest 34 and a second position P2 (FIG. 5*a*) wherein the arrow A does not rest on the arrow rest 34.

The arrow rest assembly 10 further comprises a drop-away mechanism 30 engaging the arrow rest 34, the arrow rest 34 moving with the drop-away mechanism between the first position P1 and the second position P2 in an arc about a center of rotation 31.

The arrow rest assembly 10 further comprises a driving mechanism 28 coupled to the slider 26 and driving the drop-away mechanism 30.

In all embodiments, the drop-away mechanism is preferably circular and pivots about a center of rotation, with the arrow rest 34 eccentrically mounted to the drop-away mechanism 30, with the first position P1 and the second position P2 lying at substantially opposed points about the center of rotation of the drop-away mechanism 30.

In one embodiment, shown in FIG. 2, the drop-away mechanism comprises a toothed gear 30*a*. The driving mechanism 28 further comprises a slider extension 28*a* coupled to the slider 26. The slider extension 28*a* has a toothed rack 28*a*1 coupled to the toothed gear 30*a*. The toothed gear 30*a* has as its center of rotation 31 a pivot pin 31*a* or the equivalent.

The drop-away arrow rest 34 preferably comprises a curved portion 36 and straight portion 32. The straight portion 32 is connected to the toothed gear 30*a* in an eccentric manner. The toothed gear 30*a* revolves about the pivot pin 31*a* (FIG. 3) which is mounted to the riser 4.

Figure 3:
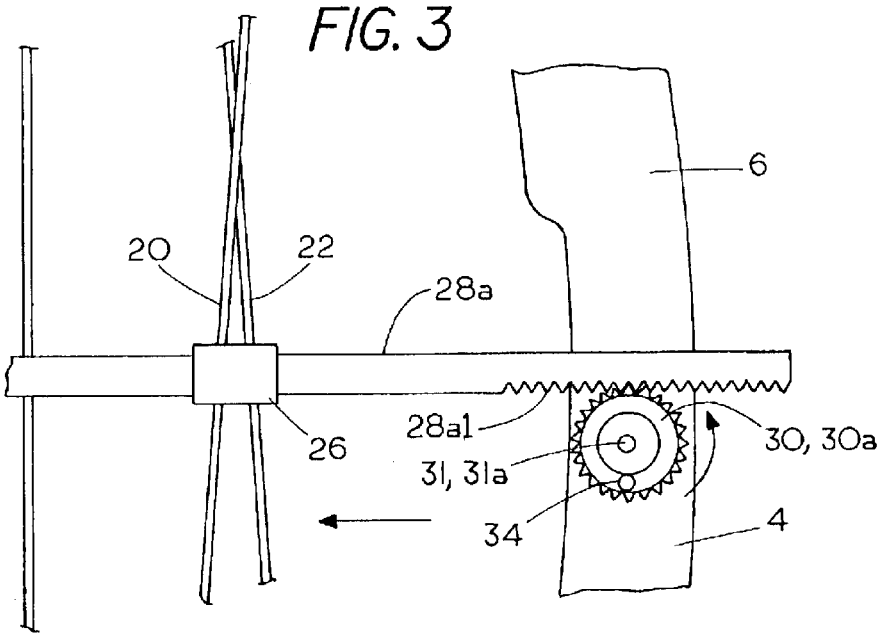
FIG. 3 is a side elevational view of a portion of a compound bow showing the drop-away arrow rest of the present invention in the resting position, before the bowstring is drawn.

In the rest position shown in FIGS. 2 and 3, the archer has placed the arrow A on the arrow rest 34. The arrow rest A is oriented so that the curved portion 36 points down. As the archer starts drawing the bowstring 18 rearwardly (in the direction shown by the arrow in FIG. 3), the slider 26, driven by cables 20 and 22, also moves rearwardly, carrying the slider extension 28*a* along with it. This causes the toothed rack 28*a*1 of the slider extension 28*a*, meshing with the toothed gear 30*a* to cause the toothed gear 30*a* to rotate in the direction shown by the arrow. This in turn brings the arrow rest 34 from the position shown P2 in FIGS. 2 and 3 to the position P1 shown in FIGS. 4 and 5.

Figure 5:
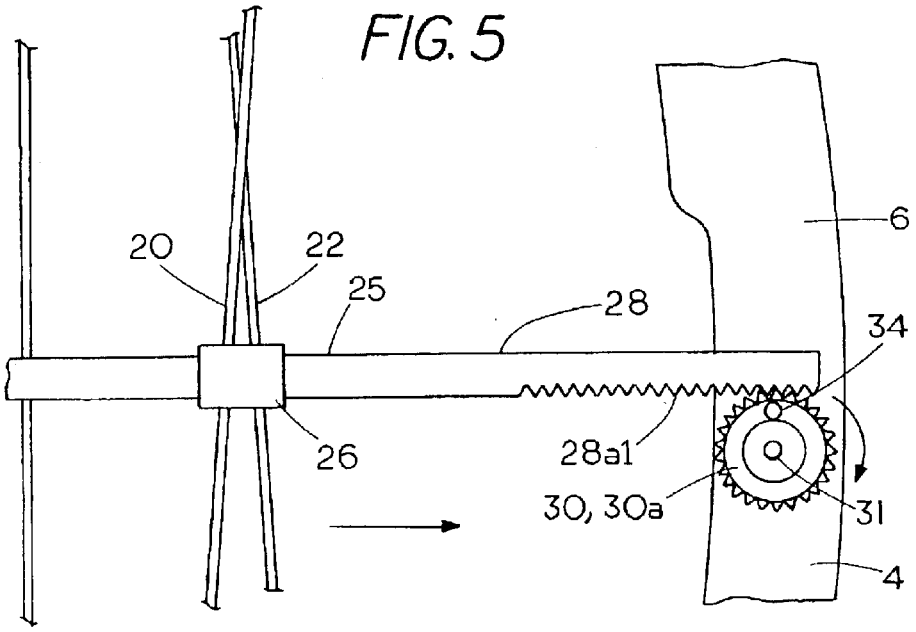
FIG. 5 is a side elevational view of a portion of a compound bow showing the drop-away arrow rest of the present invention in the firing position, after the bowstring is drawn.
Figure 5A:
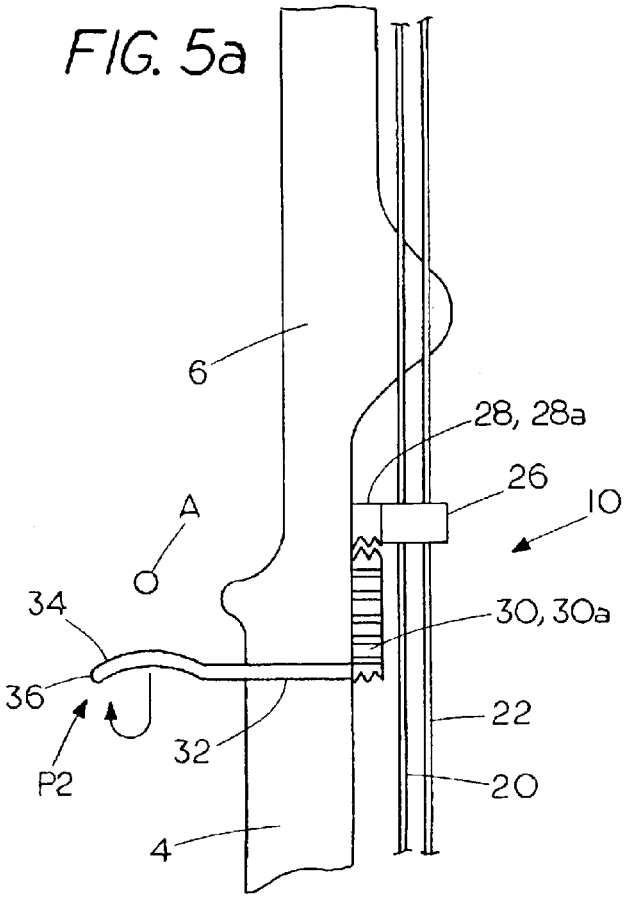
FIG. 5*a* is the same as FIG. 2.

When the archer releases the bowstring 18, the tension in the bowstring causes the slider 26 to slide rapidly along the rod portion 25, in turn causing the toothed gear 30*a* to rotate in the direction shown by the arrow in FIG. 5. This drops the arrow rest 34 quite rapidly away from the arrow back to position P2 (with the arrow not resting on the rest 34),with the result that the arrow fletching does not touch the arrow rest during release from the bow.

Figure 6:
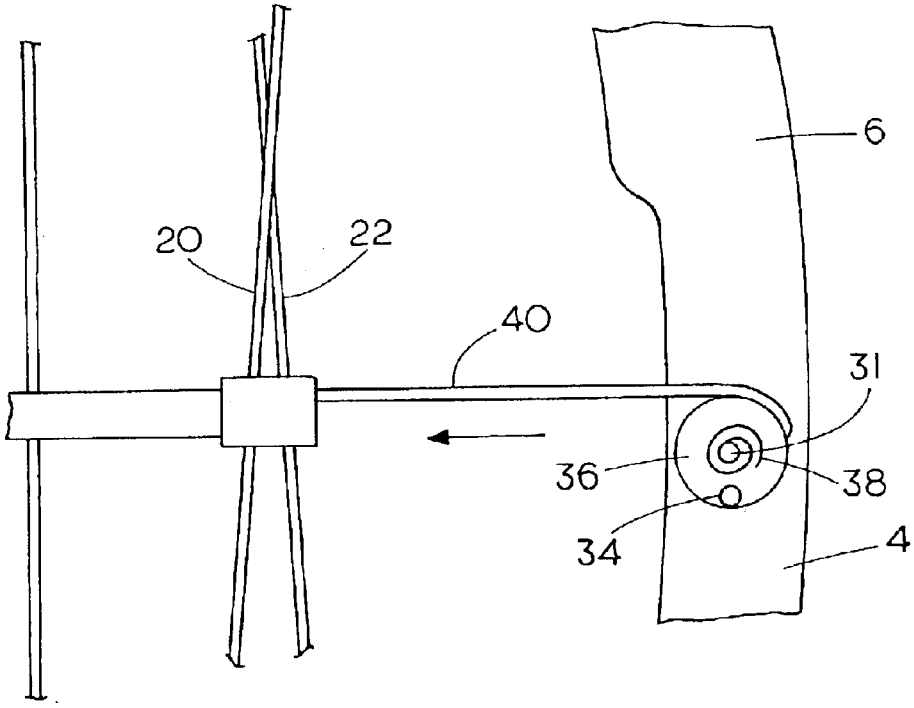
FIG. 6 is similar to FIG. 3, showing a second embodiment.

A second embodiment is shown in FIG. 6. Here, the toothed gear 30*a* is replaced by a pulley 36 and the slider extension is replaced by a pulley cable 40 that runs over the pulley 36. A torsion spring 38 works against the rotation of the pulley 36 caused by drawing the bowstring 18 rearwardly and causes the pulley 36 to rotate the arrow rest 34 to the lower position P2 when the arrow is released.

Figure 7:
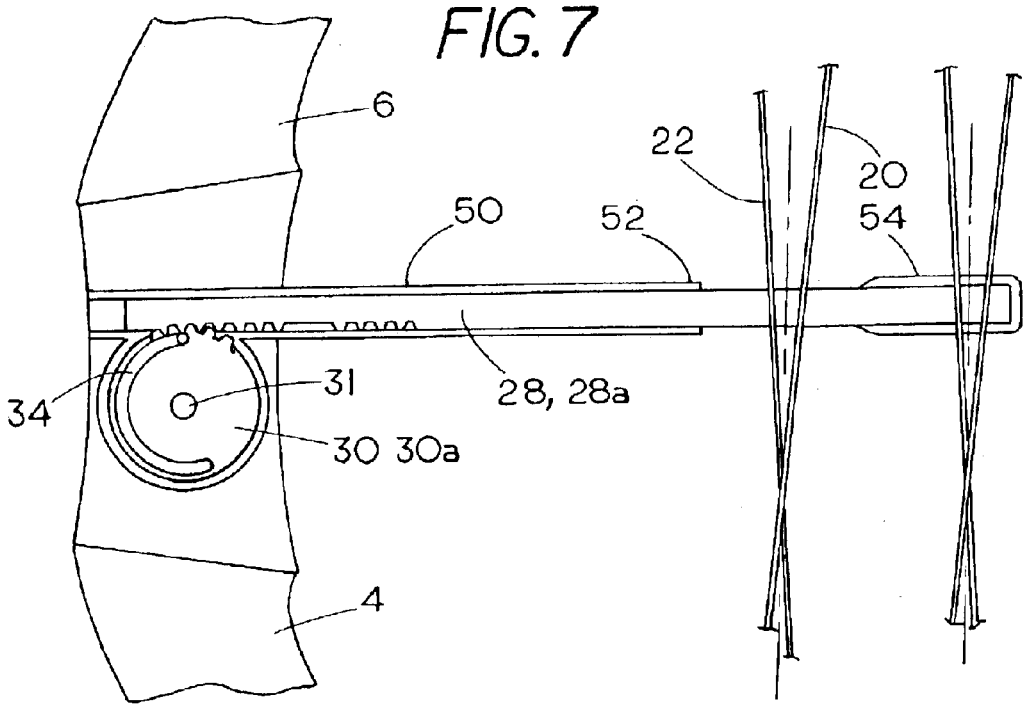
FIG. 7 is similar to FIG. 3, showing a third embodiment.

A third embodiment is shown in FIG. 7. Here, the slider extension 28*a* reciprocates within a slider extension guide 50 which is attached to the riser 4. The slider extension guide 50 prevents the slider extension 28*a* from wobbling as the cables are drawn back and released. The slider extension guide 50 may preferably have a receiver 52 into which cable attachment 54 mates when the bowstring is released and the cables 20, 22 shoot forward.

Figure 8:
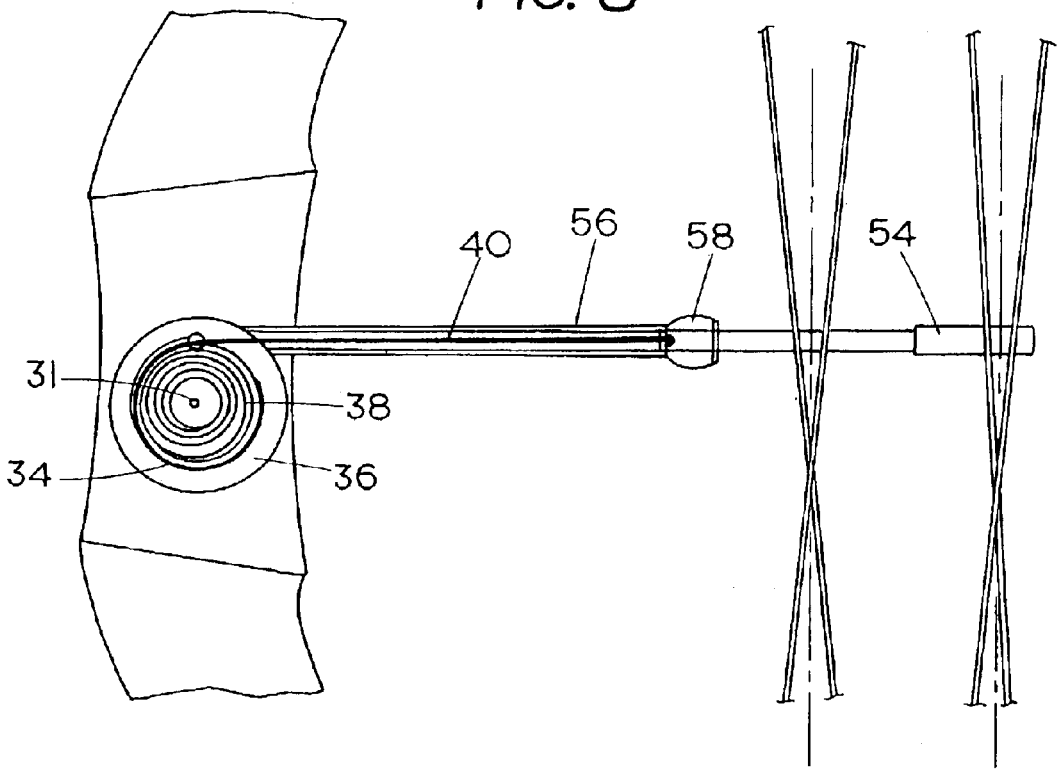
FIG. 8 is similar to FIG. 6, showing a fourth embodiment.

A fourth embodiment is shown in FIG. 8. Here, the pulley cable 40 runs within a pulley guide 56 that is attached to the riser 4. The pulley cable guide 56 may preferably have a receiver 58 into which cable attachment 54 mates when the bowstring is released and the cables 20, 22 shoot forward.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An arrow rest assembly for a compound bow, the bow having a riser, a plurality of cables, and a cable guard mounted to the riser with a slider thereon connected to the cables, the arrow rest assembly comprising:

(a) an arrow rest movable between a first position wherein an arrow rests upon the arrow rest and a second position wherein the arrow does not rest upon the arrow rest;

(b) a drop-away mechanism engaging the arrow rest, the arrow rest moving with the drop-away mechanism between the first and second position in an arc about a center of rotation; and (c) a driving mechanism adapted to be coupled to the slider and driving the drop-away mechanism;

wherein the drop-away mechanism is circular and pivots about a center of rotation, the arrow rest being eccentrically mounted to the drop-away mechanism, and wherein the first position and the second position lie at substantially opposed points about the center of rotation of the drop-away mechanism.

2. The arrow rest assembly of claim 1, wherein the drop-away mechanism further comprises a toothed gear and wherein the driving mechanism further comprises a slider extension coupled to the slider, the slider extension having a toothed rack coupled to the toothed gear, the toothed gear pivoting about a pivot pin.

3. The arrow rest assembly of claim 2, further comprising a slider extension guide within which the slider extension reciprocates, the slider extension guide being mounted on the riser.

4. The arrow rest assembly of claim 3, the slider extension guide having a first end adjacent the riser and a second end, and further comprising a receiver in the second end, and wherein the arrow rest assembly further comprises a cable attachment engaging the cables, the cable attachment mating with the receiver.

5. The arrow rest assembly of claim 1, wherein the drop-away mechanism further comprises a pulley and wherein the driving mechanism further comprises a pulley cable coupled to the slider, the pulley cable running over the pulley, and further comprising a torsion spring opposing rotation of the pulley.

6. An arrow rest assembly for a compound bow, the bow having a riser, a plurality of cables, and a cable guard mounted to the riser with a slider thereon connected to the cables, the arrow rest assembly comprising:

(a) an arrow rest movable between a first position wherein an arrow rests upon the arrow rest and a second position vertically displaced from the first position wherein the arrow does not rest upon the arrow rest;

(b) a drop-away mechanism engaging the arrow rest, the arrow rest moving with the drop-away mechanism between the first and second position in an arc about a center of rotation wherein the drop-away mechanism is circular and pivots about the center of rotation, the arrow rest being eccentrically mounted to the drops away mechanism, and wherein the first position and the second position lie at substantially opposed points about the center of rotation of the drop-away mechanism; and (c) a driving mechanism adapted to be coupled to the slider and driving the drop-away mechanism.

7. The arrow rest assembly of claim 6, wherein the drop-away mechanism further comprises a toothed gear and wherein the driving mechanism further comprises a slider extension coupled to the slider, the slider extension having a toothed rack coupled to the toothed gear, the toothed gear pivoting about a pivot pin.

8. The arrow rest assembly of claim 7, further comprising a slider extension guide within which the slider extension reciprocates, the slider extension guide being mounted on the riser.

9. The arrow rest assembly of claim 8, the slider extension guide having a first end adjacent the riser and a second end, and further comprising a receiver in the second end, and wherein the arrow rest assembly further comprises a cable attachment engaging the cables, the cable attachment mating with the receiver.

10. The arrow rest assembly of claim 6, wherein the drop-away mechanism further comprises a pulley and wherein the driving mechanism further comprises a pulley cable coupled to the slider, the pulley cable running over the pulley, and further comprising a torsion spring opposing rotation of the pulley.

* * * * *